United States Patent [19]

Hecht

[11] 4,183,523

[45] Jan. 15, 1980

[54] APPARATUS FOR FACILITATING THE PERFORMANCE OF BILLIARD SHOTS

[75] Inventor: Montague J. Hecht, Flushing, N.Y.

[73] Assignee: Abel Calderon, New York, N.Y., part interest

[21] Appl. No.: 805,239

[22] Filed: Jun. 9, 1977

[51] Int. Cl.[2] ..... A63D 15/00

[52] U.S. Cl. ..... 273/22; 273/2

[58] Field of Search ..... 273/2, 3 R, 6, 14, 22, 273/3 A, 119 R, 123 R; 35/29 R

[56] References Cited

U.S. PATENT DOCUMENTS

| | | | |
|---|---|---|---|
| 1,801,142 | 4/1931 | Crosthwait | 273/14 |
| 3,220,122 | 11/1965 | Miller | 35/29 R |
| 3,399,890 | 9/1968 | Galedrige | 273/6 |
| 3,466,038 | 9/1969 | Hill | 273/14 |
| 3,618,944 | 11/1971 | Myers | 273/14 X |
| 3,704,887 | 12/1972 | Thorton | 273/6 |
| 3,843,120 | 10/1974 | Ricci | 273/2 |
| 4,004,804 | 1/1977 | Gholson | 273/6 X |
| 4,005,861 | 2/1977 | Tomczak | 273/22 |

*Primary Examiner*—Richard T. Stouffer
*Attorney, Agent, or Firm*—Anthony H. Handal

[57] ABSTRACT

An accessory for billiard shooting is disclosed. The accessory comprises a planar element that is oriented and positioned on the billiard table playing surface. It includes marks for positioning a number of billiard ball at desired positions on the playing surface of the table. The cue ball is then put on the playing surface and driven by the cue into striking contact with the other balls, driving them into a plurality of predetermined pockets. Different "trick" shots can be performed by using differently constructed planar members.

5 Claims, 6 Drawing Figures

APPARATUS FOR FACILITATING THE PERFORMANCE OF BILLIARD SHOTS

BACKGROUND OF THE INVENTION

With the increasing popularity of billiards, many people have become interested not only in the various games that may be played with the equipment, but also with a number of interesting things which can be done with the balls in predetermined configurations. These ballistic exercises, or "trick" shots, generally involve shooting one or more of the billiard balls into predetermined pockets on the table. However, as might be expected, even with detailed instruction, many people find it impossible to perform some of the more involved and esoteric shots.

Such problems are especially acute when the shot involves a number of impacts or putting a plurality of balls into a number of predetermined pockets. In uses such as this, the placement of the balls on the table is particularly acute, though some tolerance in their placement is permissable, and must be done with a degree of accuracy.

In accordance with the present invention, a method and apparatus is provided that allows an individual to repeatedly and reliably perform such "trick" shots with a minimum of instruction and direction. Besides being simple to use and reliable, the apparatus of the present invention also has the advantage of being easy and inexpensive to manufacture.

SUMMARY OF THE INVENTION

In accordance with the apparatus of the present invention, a flat planar member for facilitating the placement of the billiard balls on the plane surface of the billiard table is provided. The planar member includes means for properly orienting and positioning the member. The member also has means for indicating the position of the billiard balls.

In accordance with the method of the present invention, a plurality of billiard balls may be driven into a plurality of predetermined pockets on a billiard table by orienting the planar member with respect to the playing surface of the billiard table. The planar member is then placed on the table at a predetermined position. A plurality of billiard balls are then placed on the planar member at positions indicated by information on the planar member. The cue ball is then placed on the billiard table at a predetermined position. The billiard cue is put in the proper position and the cue ball is struck with the tip of the cue in order to drive the various other billiard balls into the desired predetermined pockets.

DETAILED DESCRIPTION OF THE PREFERRED EMBODIMENT

Figure 1:
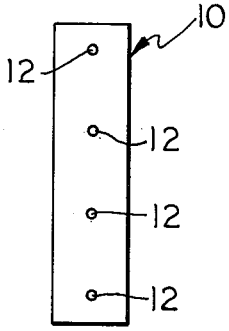
FIG. 1 is a top plan view of an embodiment of the apparatus of the present invention.

Turning to FIG. 1, a template 10 constructed in accordance with the present invention is illustrated. The template comprises a thin flat planar member which may be made of plastic or any other suitable materials such as paper, metal, or fabric. In accordance with the preferred embodiment, it is the same color as the playing surface of the table.

Template 10 includes a plurality of holes 12. These serve as indications for the placement of balls when one wishes to do a "trick" shot. Although they may be printed on the template, the fact that they are an actual physical feature of the template allows them to serve the additional purpose of guiding the position of the billiard balls. If this template is to be used with standard billiard balls, which have a diameter of 2¼ inches, then the centers of the holes 12 should be 2 3/16 inches apart. The holes should also all lie on the same line. In accordance with the preferred embodiment template 10 is made of stiff green or clear plastic that is 20 mils thick.

When it is desired to put four balls into predetermined pockets on the billiard table, template 10 is put on the playing surface. It is positioned between the two side-pockets of the billiard table and adjacent one of its side-pockets.

Figure 2:
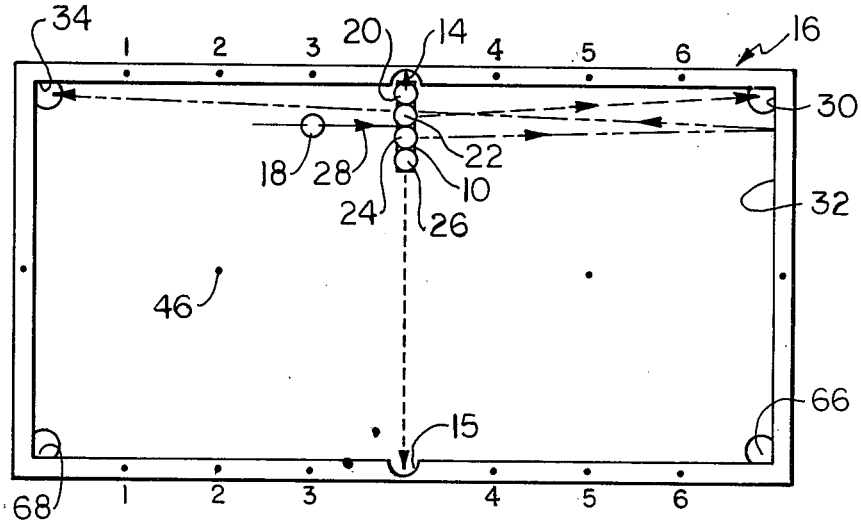
FIG. 2 shows how the method of the present invention is used with the apparatus illustrated in FIG. 1.

The table for which this embodiment is designed, as well as that for the embodiments of FIGS. 3–6, is a standard 4½ feet by 9 feet table. Template 10 is oriented with holes 12 in line with the centers of the two side-pockets 14 and 15 of table 16. A cue ball 18 is then put on the playing surface of the table in line with an imaginary perpendicular extending from the center of the template 12 as is illustrated in FIG. 2. Four balls 20, 22, 24 and 26 are then put on template 10 at holes 12. Cue ball 18 is then struck hard with a cue to move the cue ball in the direction indicated by arrow 28. When the cue ball strikes the balls in template 10, ball 20 moves into side-pocket 14, ball 22 moves into pocket 30, ball 24 bounces off the rim 32 of the table and goes into pocket 34 and ball 26 goes into pocket 15.

Figure 3:
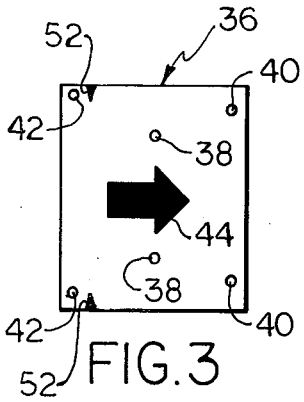
FIG. 3 is an alternative embodiment of the apparatus of the present invention.
Figure 4:
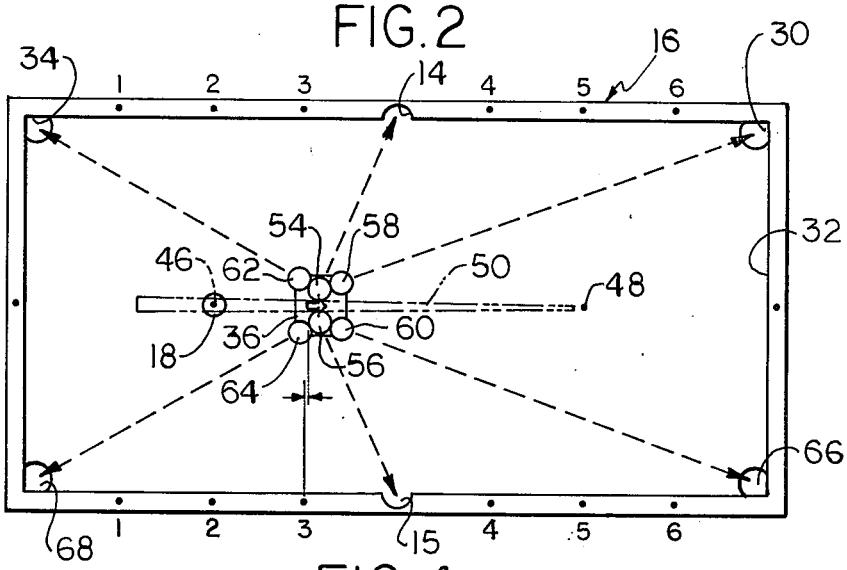
FIG. 4 shows how the apparatus of FIG. 3 is used.

Referring to FIGS. 3–4, an alternative template 36 is illustrated. This template includes a pair of medial holes 38, a pair of head holes 40 and a pair of tail holes 42. Centers of medial holes 38 are separated from each other by 3¼ inches. Centers of head holes 40 are separated from each other by 4 9/16 inches. Centers of tail holes 42 are separated from each other by 5 9/32 inches. The distance between the center of each medial hole 38 and head hole 40 on the same side of arrow 44, which is printed on template 36, is 2 3/16 inches. The distance between the center of each medial hole 38 and each tail hole 42 on the same side of arrow 44 is 2 3/16 inches. Arrow 44 is, in turn, centered on a line which lies centered between each of the two holes of the pairs of medial, head and tail holes. Each of the pairs of holes thus define lines perpendicular to arrow 44.

When it is desired to make the desired trick shot with template 36, template 36 is positioned and oriented on the playing surface, as shown in FIG. 4, with its center lying along a line defined by the two "spots" 46 and 48 on the table. This may be facilitated by using a cue 50 and lining template 36 up with its arrow 44 centered underneath cue 50 when cue is laid over spots 46 and 48, as is illustrated in phantom in FIG. 4.

Table 16 has the standard six pairs of side diamonds which are numbered 1–6 in standard form on the drawings. The lateral position of the template is determined by lining up arrows 52 printed on template 36 with the three-diamonds, indicated by the numeral "3" in FIG. 4. The proper positioning of arrows 52 is assured by the following procedure. When two billiard balls 54 and 56 are put in medial holes 38 and a plane perpendicular to the plane of template 36 is positioned tangent to the surfaces of the two billiard balls on their sides that are adjacent the tail holes 42, the line defined by the intersection of the two planes should be ½ inch removed from the line defined by the centers of the two tail holes 42 and displaced toward the center of the table.

When template 36 is in the desired position, balls 54, 56, 58, 60, 62 and 64 are placed on template 36. Cue ball 18 is then placed on head spot 46. A cue is then used to advance cue ball 18 toward the center of the configuration of billiard balls on template 36. Ball 54 then enters pocket 14; ball 56 enters pocket 15; ball 58 enters pocket 30; ball 60 enters pocket 66; ball 62 enters pocket 34; and ball 64 enter pocket 68.

Figure 5:
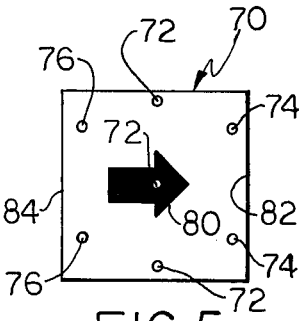
FIG. 5 is a top plan view of still another embodiment of the apparatus of the present invention.
Figure 6:
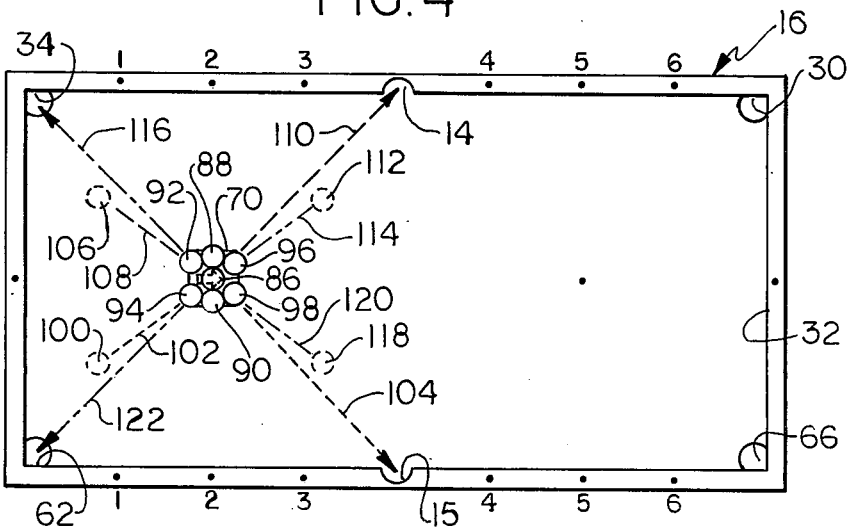
FIG. 6 shows how the apparatus of FIG. 5 is used.

Referring to FIGS. 5 and 6, still another alternative embodiment of the present invention is illustrated. The template 70 illustrated in FIG. 5 has a pair of medial holes 72, a pair of head holes 74, a pair of tail holes 76 and a central hole 78. The head holes 74 lie along a line perpendicular to printed arrow 80, as do pairs of medial holes 72 and tail holes 76. The lines defined by each of the pairs of holes are also all parallel to sides 82 and 84 of the rectangular template. The distance between the centers of each of the head holes 74 and tail holes 76 and the center of central hole 78 is 2½ inches. The center of medial holes 72 are separated from the centers of the central hole 78 by 2 3/16 inches. The center of each medial hole 72 is separated from the centers of both the head hole 74 and tail hole 76 on the same side of arrow 80 that the medial hole occupies by a distance of 2 3/16 inches.

When it is desired to make the shot, template 70 is put on the playing surface of the table as illustrated in FIG. 6 with central hole 78 over head spot 46 and side 82 parallel to side 32 of the table 16. Balls 86, 88, 90, 92, 94, 96 and 98 are then placed on the template.

If one wants to put ball 86 into pocket 15, a cue ball 100 is put at a point along a path 102 defined by the centers of balls 94, 86 and 96. Cue ball 100 is then struck hard, driven along path 102 and ball 86 follows path 104.

If one wants to put ball 86 into pocket 14, a cue ball 106 is put at a point along a path 108 defined by the centers of balls 92, 86 and 98. Cue ball 106 is then struck hard, driven along path 108 and ball 86 follows path 110.

If one wants to put ball 86 into pocket 34, a cue ball 112 is put at a point along a path 114 defined by the centers of balls 96, 86 and 94. Cue ball 112 is then struck hard, driven along path 114 and ball 86 follows path 116.

If one wants to put ball 86 into pocket 68, a cue ball 118 is put at a point along a path 120 defined by the centers of balls 98, 86 and 92. Cue ball 118 is then struck hard, driven along path 120 and ball 86 follows path 122.

While several illustrative embodiments of the invention have been disclosed, it is understood that various modifications will be obvious to those of ordinary skill in the art. For example, for balls of smaller diameter the dimensions of the templates would all be reduced in the same proportion. Such modifications are within the spirit and scope of the invention which is limited and defined only by the appended claims.

I claim:

1. Apparatus for facilitating the performance of billiard shots involving a plurality of billiard balls, comprising a flat planar member configured and dimensioned to overlie a portion of the playing surface of a billiard table and support a plurality of billiard balls in such a manner that a first billiard ball advancing toward another ball resting on said planar member will strike the other ball before contacting said planar member; a plurality of marks indicating the placement of billiard balls being disposed on said planar member, said marks being positioned with respect to each other in such a manner that when each of said marks has one of said balls placed over it, and when one of said balls placed over one of said marks is struck by a single shot of said first ball, said single shot results in contact between said first and said one of said billiard balls before said first ball hits said planar member, and all of the balls resting over said marks on said planar member are sunk in predetermined plural pockets of the billiard table with each of said pockets having at least one of said balls sunk therein as a result of said single shot; angular orientation means disposed on said planar member; and means for indicating the position of said planar member on said playing surface disposed on said planar member.

2. Apparatus as in claim 1, wherein said angular orientation means comprises printed markings disposed on said planar member.

3. Apparatus as in claim 1, wherein said angular orientation means is on the outside perimeter of the planar member.

4. Apparatus as in claim 3, wherein said positioning means comprises a pair of marks printed on the perimeter of said planar member.

5. Apparatus as in claim 1, wherein said marks are a plurality of holes which serve to physically guide the placement and retention of billiard balls on the planar member.

* * * * *